US005628257A

United States Patent [19]

Conner et al.

[11] Patent Number: 5,628,257

[45] Date of Patent: *May 13, 1997

[54] FURNITURE WORKSURFACE UNIT AND METHOD

[75] Inventors: John P. Conner, Grandville, Mich.; Paul Haigh, Greenwich, Conn.; James W. Ross, Grand Rapids, Mich.; William C. Small, Greenville, Mich.; Bradley D. Youngs, Grand Rapids, Mich.

[73] Assignee: Steelcase Inc., Grand Rapids, Mich.

[ * ] Notice: The term of this patent shall not extend beyond the expiration date of Pat. No. 5,546,873.

[21] Appl. No.: 629,270

[22] Filed: Apr. 8, 1996

Related U.S. Application Data

[62] Division of Ser. No. 331,010, Oct. 28, 1994, Pat. No. 5,546,873.

[51] Int. Cl.[6] ..... A47B 3/06

[52] U.S. Cl. ..... 108/153; 108/90; 108/65; 312/195

[58] Field of Search ..... 108/153, 50, 90, 108/185, 64, 65, 152, 186, 62, 193, 69, 190, 155, 156, 157; 52/36.1, 239; 312/140.3, 195, 265.1, 265.4, 223.3, 223.6, 140.4, 265.6

[56] References Cited

U.S. PATENT DOCUMENTS

| | | | |
|---|---|---|---|
| D. 161,772 | 1/1951 | Macdonald . | |
| D. 193,192 | 7/1962 | Blevins . | |
| D. 210,131 | 2/1968 | Rourke . | |
| D. 223,838 | 6/1972 | Valic . | |
| D. 242,832 | 12/1976 | Swensson . | |
| D. 320,904 | 10/1991 | Coleman et al. . | |
| 1,967,979 | 7/1934 | Stern . | |
| 2,092,441 | 9/1937 | Ciprus . | |
| 2,231,261 | 2/1941 | Eustis | 108/185 |
| 2,560,400 | 7/1951 | Abrahamson | 312/195 |
| 2,661,994 | 12/1953 | Knuth | 108/185 X |
| 2,872,259 | 2/1959 | Thorpe | 108/69 |
| 2,930,665 | 3/1960 | Budai | 312/195 X |
| 3,093,096 | 6/1963 | Black et al. . | |
| 3,105,726 | 10/1963 | Jung . | |
| 3,437,390 | 4/1969 | Evans | 108/64 X |
| 3,554,140 | 1/1971 | Homesberger | 108/90 |
| 3,583,337 | 6/1971 | Yokeley . | |
| 3,714,906 | 2/1973 | Finestone . | |
| 3,741,852 | 6/1973 | Keener . | |
| 4,066,305 | 1/1978 | Gazarek . | |
| 4,103,981 | 8/1978 | Donahue et al. . | |
| 4,163,592 | 8/1979 | Nelson . | |
| 4,665,836 | 5/1987 | Burr . | |
| 4,665,838 | 5/1987 | Minshall | 108/153 X |
| 4,732,088 | 3/1988 | Koechlin et al. . | |
| 4,869,564 | 9/1989 | Lechman | 312/195 |
| 5,035,470 | 7/1991 | Miller . | |
| 5,050,829 | 9/1991 | Sykes . | |
| 5,163,373 | 11/1992 | Anderson et al. . | |
| 5,176,435 | 1/1993 | Pipkens . | |
| 5,357,874 | 10/1994 | Palmer | 108/50 |

FOREIGN PATENT DOCUMENTS

| | | | |
|---|---|---|---|
| 2243797 | 3/1973 | Germany | 108/153 |
| 4197201 | 7/1992 | Japan | 312/195 |
| 2217588 | 11/1989 | United Kingdom | 108/153 |
| 2232586 | 12/1990 | United Kingdom | 108/90 |

*Primary Examiner*—Peter M. Cuomo
*Assistant Examiner*—Janet M. Wilkens
*Attorney, Agent, or Firm*—Price, Heneveld, Cooper, DeWitt & Litton

[57] ABSTRACT

A furniture worksurface unit for desks, tables, computer supports, etc. has a unique modular construction, comprising a top assembly with a skeleton-like top frame and a worksurface skin mounted on the upper side thereof. Leg frames are attached to the opposite ends of the top frame, and support the worksurface unit freestanding on a floor surface. Inner and outer leg covers enclose the leg frames, and underbelly covers are provided to enclose any exposed portions of the lower side of the top frame to facilitate manufacturing the worksurface unit in different widths from common parts, and provide aesthetic flexibility. Removable edges are mounted on the sides of the top frame, and are provided in assorted shapes and sizes to construct various top configurations.

8 Claims, 5 Drawing Sheets

FURNITURE WORKSURFACE UNIT AND METHOD

This is a divisional of application Ser. No. 08/331,010, filed on Oct. 28, 1994, now U.S. Pat. No. 5,546,873.

BACKGROUND OF THE INVENTION

The present invention relates to furniture worksurface units, such as for desks, tables, computer supports, and the like, and in particular to a unique construction and method therefor.

Furniture worksurface units are generally well known in the art, and are used extensively as desks, tables, computer supports, and other similar furniture articles. Pleasing aesthetics, high strength and low weight are clearly advantageous features that are desirable in worksurface units, as is the ability to manufacture the same efficiently and economically. Modern office environments typically employ systems or modular furniture arrangements, wherein the various furniture elements are matched or coordinated in both function and design. To effectively meet these needs, current worksurface designs must be available in a wide variety of different shapes and sizes, and are preferably reconfigurable to meet the ever-changing needs of different users.

SUMMARY OF THE INVENTION

One aspect of the present invention is a worksurface unit, comprising a top assembly including a top skin supported on a structural top frame having front and rear frame members extending along front and rear edges of the top assembly. First and second torsion tubes extend along the interior sides of the front and rear frame members, with gussets extending laterally in between the front and rear frame members and the first and second torsion tubes at locations intermediate opposite ends thereof to fixedly interconnect the same. First and second end supports have lower ends shaped for abutting support on a floor surface, and upper ends connected with the opposite ends of the front and rear frame members and the first and second torsion tubes.

Another aspect of the present invention is a worksurface unit, comprising a worksurface frame having a top frame member with upper and lower sides, and being supported adjacent opposite ends thereof by first and second end frame members. A top skin is connected with and covers the upper side of the top frame member. At least one outer leg cover is connected with and encloses an exterior side of an associated one of the end frame members. At least one inner leg cover is connected with an interior side of the associated one of the end frame members, and has an inverted L-shaped side elevational configuration which wraps around and encloses the interior side of the associated end frame, and at least a portion of the lower side of the top frame member.

Yet another aspect of the present invention is a worksurface unit, comprising a skeleton-like top frame, having a support connected therewith to support the same at a predetermined elevation. A top skin is connected with the upper side of the top frame, and covers the same. At least one underbelly cover is connected with the lower side of the top frame, and covers at least a portion of the same, and facilitates manufacturing the worksurface unit in different widths from common parts.

Yet another aspect of the present invention is a worksurface kit, comprising a top having a generally rectangular plan configuration. A support is connected with the top, and has a lower end thereof shaped for abutting support on a floor surface. A plurality of front and rear edges are shaped to matingly abut with the front and the rear edges of the top. The front and rear edges have a variety of different sizes, and are detachably mounted to the top to facilitate forming various top configurations.

Yet another aspect of the present invention is a worksurface unit, comprising a top, having a support connected therewith for abutting support on a floor surface. A removable edge is shaped to mate with a side edge of the top, and includes a normally upwardly facing surface having a first shape, and a normally downwardly facing surface having a second shape that is different from the first shape. A fastener detachably connects the edge to the top and is symmetrically arranged to permit the edge to be connected to the top in an upside down orientation, with the second shape facing upwardly, to facilitate forming various top configurations.

Yet another aspect of the present invention is a worksurface system comprising a plurality of worksurface units shaped to be positioned end-to-end and back-to-back to create at least one workstation. Each worksurface unit has a top with marginal side edges, a floor engaging support connected with the top, and a plurality of removable edges shaped to matingly abut with the marginal side edges of the top. The removable edges have a variety of different sizes and shapes, and are detachably mounted to the top to facilitate forming various top configurations.

Yet another aspect of the present invention is a method for making modular worksurface units in multiple widths from common parts. A plurality of top assemblies are provided in multiple widths which vary by a predetermined interval. A plurality of substantially identical end supports are provided, each having a leg frame, and inner and outer covers to enclose the opposite sides thereof. A plurality of substantially identical underbelly covers are each shaped to enclose a bottom portion of an associated top, and have a width equal to the predetermined width interval of the top assemblies. The end frames are attached to the opposite ends of the top assembly, and the inner and outer leg covers are mounted in place. Underbelly covers are then mounted to the lower side of the top assembly, extending between the inner leg covers, to fully enclose the lower side of the top assembly.

The principal objects of the present invention are to provide a unique construction for worksurface units and the like, that is particularly adapted for constructing systems furniture, modular furniture, and other similar types of furniture arrangements. The worksurface unit has pleasing aesthetics, as well as high strength and low weight. Furthermore, the worksurface unit includes a common core from which a plurality of differently shaped and sized worksurface units can be constructed, so as to greatly increase manufacturing efficiency and reduce costs. The worksurface unit is preferably reconfigurable, and has substantial aesthetic flexibility, with a knockdown construction to facilitate storage and transport.

These and other advantages of the invention will be further understood and appreciated by those skilled in the art by reference to the following written specification, claims, and appended drawings.

DETAILED DESCRIPTION OF THE PREFERRED EMBODIMENTS

Figure 1:
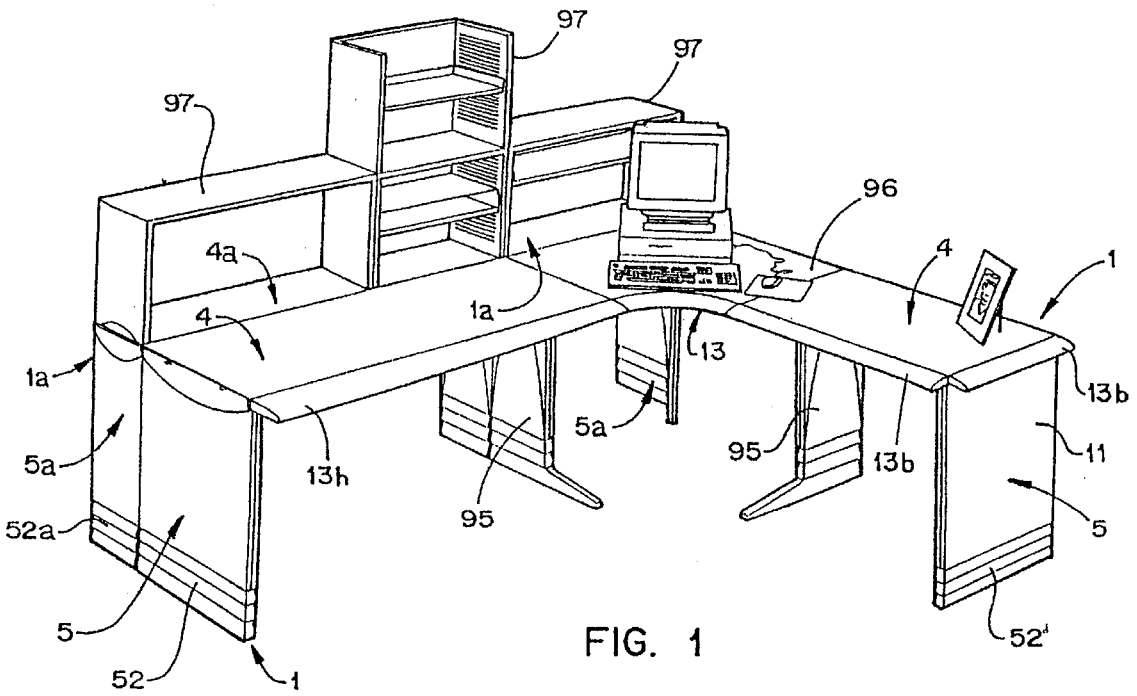
FIG. 1 is a perspective view of a system or arrangement of worksurface units embodying the present invention.
Figure 2:
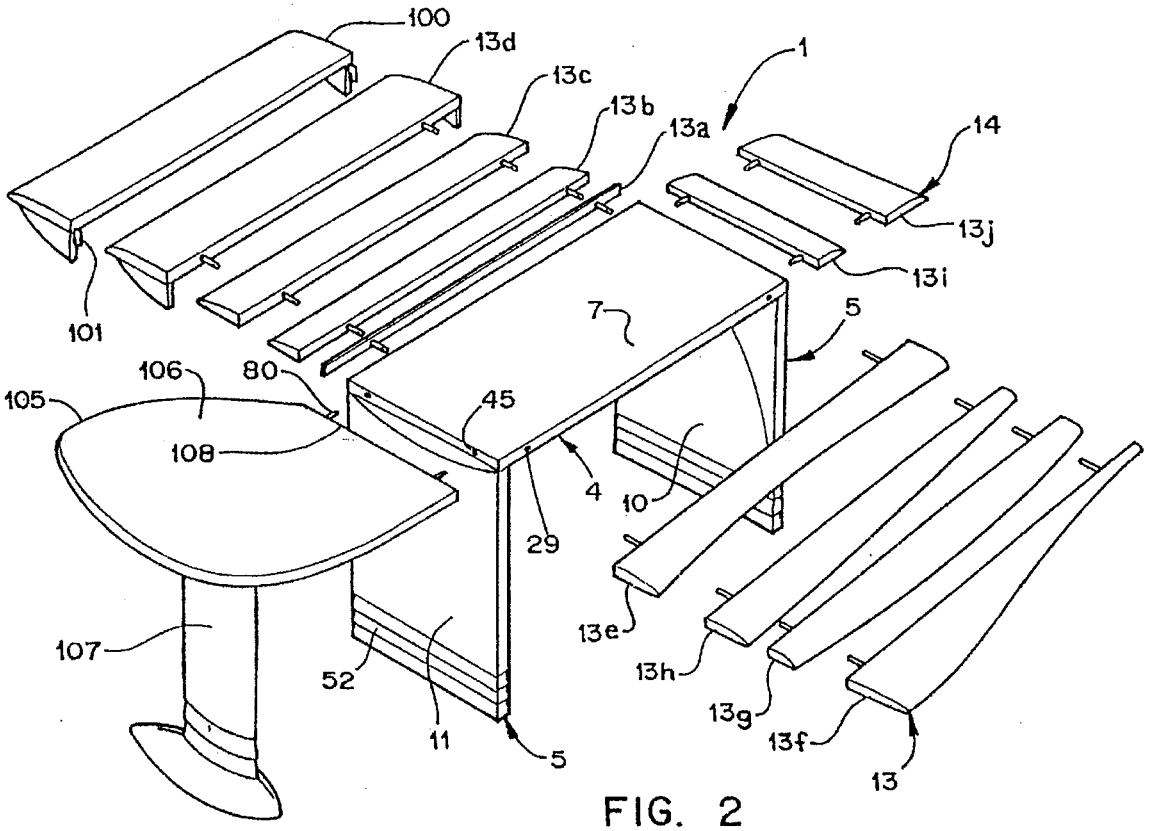
FIG. 2 is an exploded, perspective view of a single worksurface unit, showing various removable edge configurations.

For purposes of description herein, the terms "upper," "lower," "right." "left," "rear," "front," "vertical," "horizontal," and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (Fig. 1) generally designates a worksurface unit embodying the present invention. Worksurface unit 1 has a modular construction, which permits like worksurface units to be arranged or positioned in end-to-end, back-to-back, and other such relationships, so as to create a wide variety of differently shaped workstations, such as the fully integrated workstation illustrated in FIG. 1. Each worksurface unit 1 has a substantially identical construction, and may be used as a desk table, computer support, return and/or other similar furniture article, which are generically referred to herein as a "worksurface unit".

Figure 3:
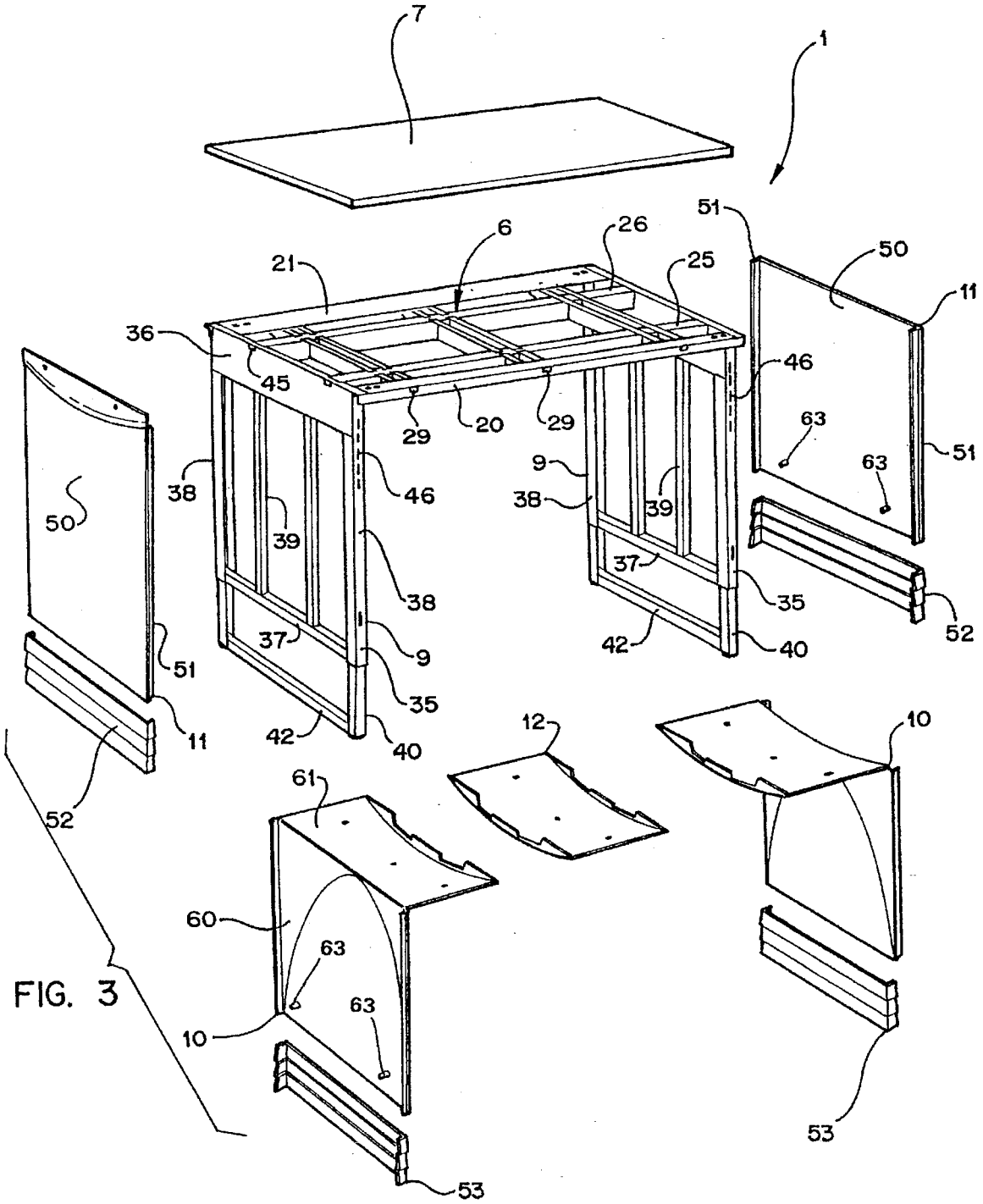
FIG. 3 is an exploded, perspective view of the worksurface unit, showing internal construction thereof.

Each worksurface unit 1 includes a top assembly 4 (FIGS. 1 & 2), which is supported at opposite sides or ends thereof by a pair of end supports or leg assemblies 5. As best illustrated in FIG. 3, top assembly 4 includes a structural top frame 6 with a worksurface skin 7 mounted on the upper side thereof. Each leg assembly 5 includes a structural leg frame 9, which is connected to an associated one of the opposite ends of top frame 6, and supports the worksurface unit 1 freestanding on a floor surface. Inner and outer leg covers 10 and 11 respectively, enclose leg frames 9. The inner leg covers 10 have an inverted L-shape construction, which wraps around both the interior sides of leg frames 9, and at least portions of the lower sides of the top frame 6. Underbelly covers 12 are provided to enclose any remaining, exposed portions of the lower side of top frame 6. Removable edges 13 (FIGS. 1 & 2) are mounted on the side edges of top assembly 4, and are provided in assorted shapes and sizes to construct various top configurations.

Figure 4:
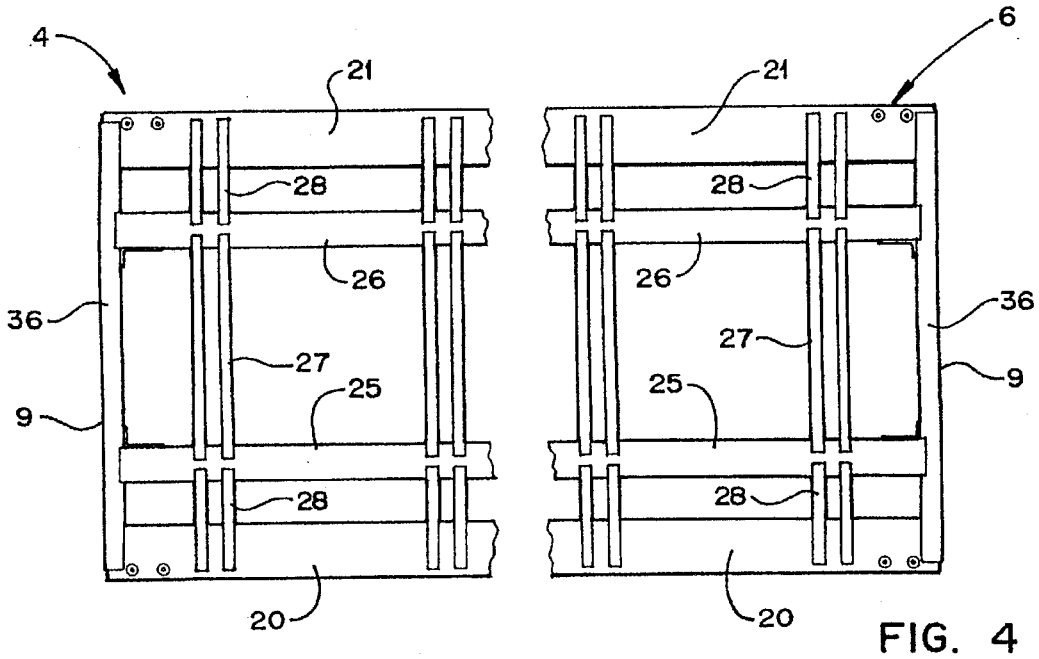
FIG. 4 is a fragmentary top plan view of a frame portion of the worksurface unit.
Figure 5:
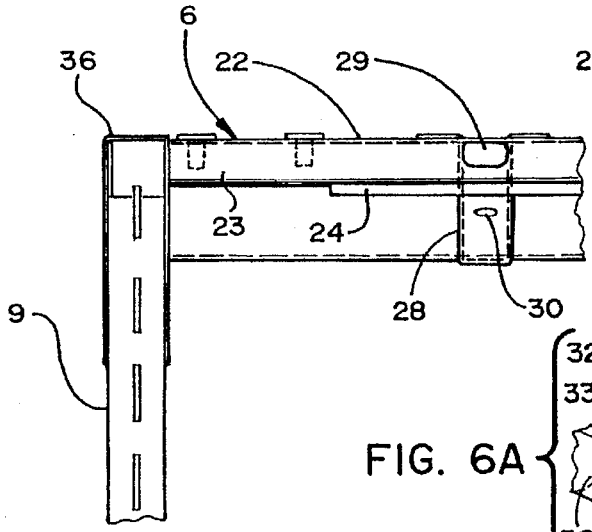
FIG. 5 is a fragmentary, front elevational view of the worksurface frame.
Figure 6:
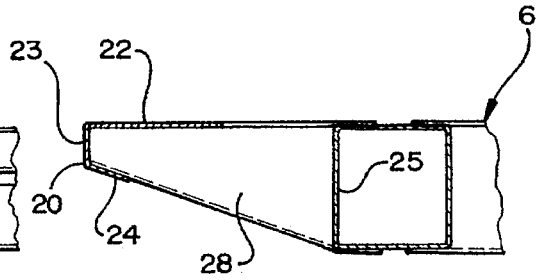
FIG. 6 is a fragmentary, vertical cross-sectional view of a gusset portion of the FIG. 6A is an exploded, fragmentary, perspective view of the worksurface

The illustrated top assembly 4 (FIGS. 3–7) has a skin and frame construction, wherein top frame 6 has a skeleton-like plan shape, comprising front and rear frame members 20 and 21 which extend along the front and rear edges of top assembly 4. Front and rear frame members 20 and 21 have a substantially identical construction, comprising an inwardly opening, generally C-shaped channel, having an enlarged horizontal top flange 22, a vertical side flange 23, and a relatively short bottom flange 24 that inclines downwardly toward the interior of top assembly 4. A pair of torsion tubes 25 and 26 extend along the interior sides of the front and rear frame members 20 and 21, and are positioned parallel therewith. As best illustrated in FIGS. 4–6, torsion tubes 25 and 26 have a substantially identical construction, wherein each has a hollow, square vertical cross-sectional shape, constructed from a relatively rigid material, such as steel or the like. Torsion tubes 25 and 26 are spaced apart from front and rear frame members 20 and 21, toward the interior of top frame 6 a preselected distance, and serve to provide additional rigidity thereto.

Gussets 27 and 28 extend laterally in between the front and rear frame members 20 and 21 and the two torsion tubes 25 and 26 at locations intermediate the opposite ends thereof, and serve to fixedly interconnect the same in a grid-like or skeleton-like fashion, as shown in FIG. 4. The interior gussets 27 have an upwardly opening, generally U-shaped vertical cross-sectional configuration, with opposite ends thereof fixedly connected to torsion tubes 25 and 26. Interior gussets 27 are arranged in a mutually parallel relationship, and are spaced uniformly along the width of top frame 6. The outer gussets 28 also have an upwardly opening, generally U-shaped vertical cross-sectional configuration, and are aligned with interior gussets 27. The opposite ends of outer gussets 28 are fixedly connected with torsion tubes 25 and 26, and front and rear frame members 20 and 21. As best illustrated in FIG. 6, outer gussets 28 have a tapered side elevational configuration which extends to the lower surface of associated torsion tubes 25 to the bottom flange 24 of the associated frame member 20. The side flanges 23 of front and rear frame members 20 and 21 each include a series of fastener apertures 29 (FIGS. 3 & 5) therethrough, each of which is aligned with the interior of an associated outer gusset 28 to facilitate attachment of movable edges 13, as described in greater detail hereinbelow. Each of the outer gussets 28 also include an access window 30 along the lower side thereof to facilitate the mounting of removable edges 13.

The illustrated top skin 7 is relatively thin, and is detachably mounted on the upper side of top frame 6 by a suitable fastening arrangement, such as hook & loop strips, screws or the like, such that top skin 7 can be removed and replaced. Skin 7 is typically selected from a wide variety of different materials, textures, colors, etc. to provide a writing surface or the like on the upper side thereof, and may be constructed from vinyl, wood, and other similar materials. The opposite ends of top frame members 20 & 21 and 25 & 26 each have a pair of downwardly oriented tabs 32 shaped to be closely received in associated slots 33 in leg frames 9 to detachably interconnect the same, as described more fully below. In this fashion, different sizes and types of top assemblies 4 can be used with the same pair of leg frames 9.

Figure 10:
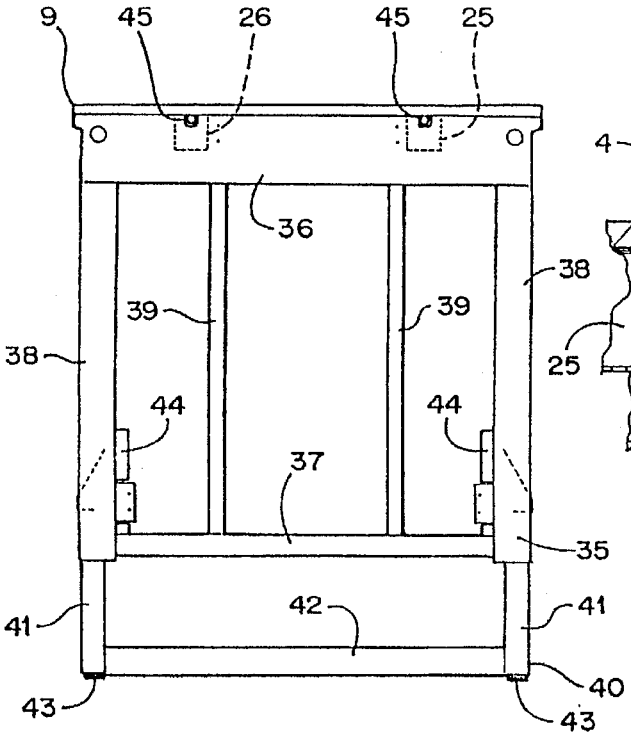
FIG. 10 is a side-elevational view of the worksurface frame.

The leg frames 9 shown in FIGS. 3 and 10 have a substantially identical construction, wherein each includes an upper skeleton-like segment 35 with upper and lower horizontal members 36 and 37, a pair of end tubes 38 along opposite sides thereof, and vertical cross members 39, all of which are rigidly interconnected. A lower-frame segment 40 is telescopingly mounted in the lower end of upper segment 35, and includes a pair of vertical tubes 41 which are telescopingly received in end tubes 38, and are laterally interconnected by a lower cross-brace 42. Glides 43 are mounted at the lower ends of tubes 41, and serve to abut an associated floor surface. A pair of lock mechanisms 44 are provided on opposite sides of leg frame 9, and selectively interconnect upper and lower leg segments 35 and 40 in a variety of different elevations, so as to vary the overall height of worksurface unit 1. Hence, worksurface unit 1 can be readily adjusted for use as a school desk, a handicapped workstation, etc., as well as to both U.S. and metric worksurface heights. Each upper frame member 36 includes a pair of fastener apertures 45, which are aligned with the ends of torsion tubes 25 and 26 to facilitate attachment of removable edges 14, as described below. Leg frames 9 need not be surface finished, since they are fully enclosed by leg covers 10 and 11. A series of vertical slots 46 (FIG. 3) are provided in the forward faces of upper frame members 36 to provide vertically adjustable support for a keyboard edge 100 or the like, as discussed below.

Figure 6A:
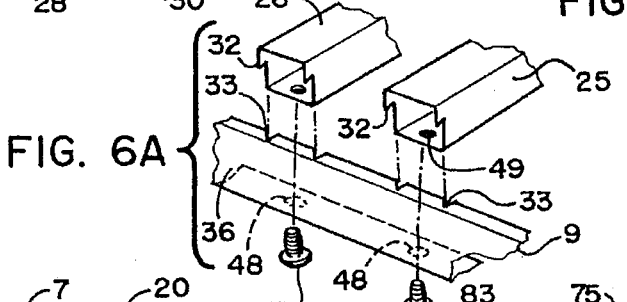

As noted above, the upper horizontal members 36 of end frames 9 include a series of slots 33 (FIG. 6A) along their upper edge in which the tabs 32 on top frame members 20 & 21 and 25 & 26 are received. Fasteners 47 extend vertically upwardly through mating apertures 48 in the lower portions of leg frame members 36, and engage apertures 49 in the lower portions of top frame members 20 & 21 and 25 & 26 to detachably, yet securely mount leg frames 9 on the opposite ends of top frame 6. This tab and slot interconnection permits worksurface unit 1 to be stored and/or shipped in a very compact, knocked down condition, and easily assembled at the use site.

In the illustrated worksurface unit 1 (FIG. 3), the opposite sides or faces of leg frames 9 are enclosed by relatively thin, lightweight leg covers 10 and 11. The outer leg cover 11 has a generally planar center panel 50, with inwardly turned flanges 51 extending along the opposite side edges thereof. Outer leg cover 11 is shaped to cover the upper segment 35 of leg frame 9, and extends laterally approximately halfway over frame end tubes 38. A pair of plinth covers 52 and 53 are mounted on opposite sides of the lower frame segment 40 (FIGS. 3 & 12–14), and enclose the same.

Figure 13:
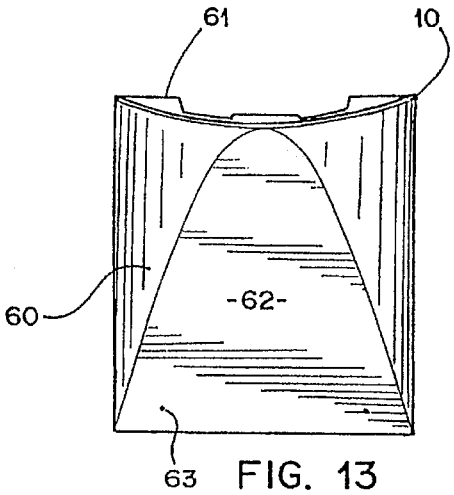
FIG. 13 is a side elevational view of the inner leg cover.
Figure 14:
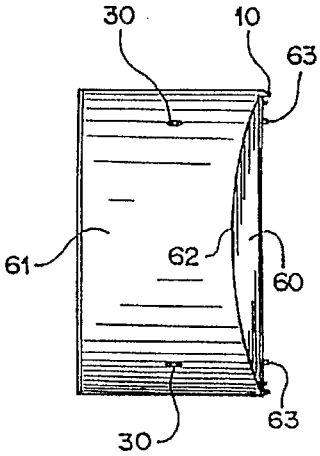
FIG. 14 is a bottom plan view of the leg inner cover.
Figure 15:
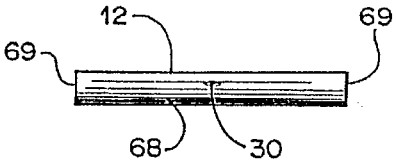
FIG. 15 is a front elevational view of an underbelly cover.
Figure 16:
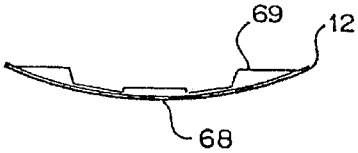
FIG. 16 is a side elevational view of the underbelly cover.
Figure 17:
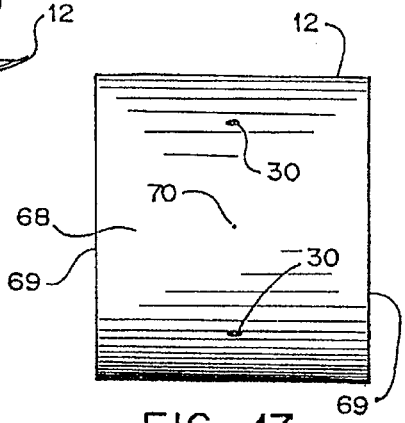
FIG. 17 is a bottom plan view of the underbelly cover.

The illustrated inner leg covers 10 have an inverted L-shaped side elevational configuration, comprising integrally formed vertical leg portion 60 and horizontal leg portion 61. The vertical leg portion 60 is shaped to cover the interior side of upper frame segment 35, and has a tapered side elevational shape (FIGS. 12–14), as well as an inwardly inclined center area 62 having a parabolic front elevational configuration, as best shown in FIG. 13. The horizontal leg potion 61 of inner leg cover 10 has a downwardly bowed arcuate shape which blends into the tapered upper area of horizontal leg portion 61. Fastener bosses 63 are provided on both covers 10 & 11, and serve to assist in attaching the same to an associated leg frame 9 with threaded fasteners (not shown).

Figure 18:
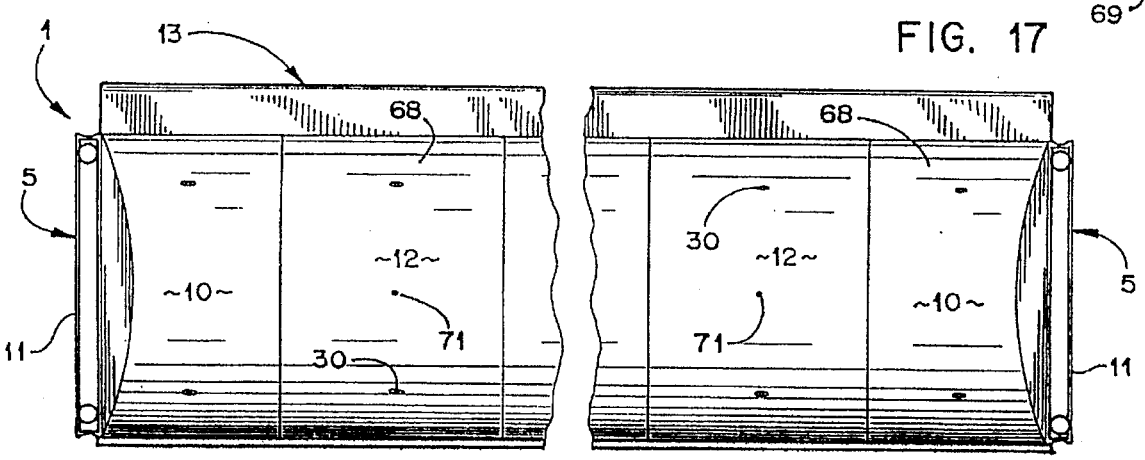
FIG. 18 is a fragmentary, bottom plan view of an elongated worksurface unit.

The underbelly covers 12 shown in FIGS. 3 and 15–18 are provided to enclose any uncovered or exposed portion of the lower side of top frame 6. Underbelly covers 12 are also relatively thin and lightweight, and are constructed in a modular fashion, such that worksurface unit 1 can be manufactured in a variety of different widths, while using common parts, as discussed more fully below. Each underbelly cover 12 has a downwardly bowed, center panel 68, and opposite side edges 69 that are shaped to matingly abut the adjacent sides of like underbelly covers 12, as well as the ends of the vertical leg portions 60 of inner leg covers 10. Fastener bosses 70 are provided to attach the underbelly covers 12 to the lower side of top frame 6 with threaded fasteners 71 (FIG. 18). The downwardly bowed shape of underbelly covers 12 permits various accessories, such as modems, switches, electrical equipment 72 (FIG. 7), and the like to be mounted on the lower side of top frame 6, and safely retained in the space or void formed by the underbelly covers 12.

The illustrated leg and underbelly covers 10–12 may be constructed from a very lightweight synthetic resin material, such as ABS plastic. Preferably, the material used for covers 10–12 can be readily recycled, such that repair and refurbishment of worksurface units 1 can be achieved with minimum raw material usage. Also, covers 10–12 may be provided in different colors, textures, exterior shapes, etc. to add substantial aesthetic flexibility to the worksurface system.

Removable edges 13 (FIG. 2) are detachably mounted on the edges of top frame 6, and facilitate forming various top configurations. For example, the illustrated front and rear removable edges 13 are provided in a variety of different shapes and sizes, including a thin straight cover edge 13*a*, two different widths of straight extension edges 13*b* and 13*c*, and a straight cantilever extension edge 13*d*, as well as a front curve bowed edge 13*e*, a serpentine edge 13*f*, an outwardly bowed edge 13*g*, and an asymmetrical edge 13*h*. The illustrated side removable edges 13 include two different widths of straight extension edges 13*i* and 13*j*. All removable edges 13, whether shown in relation to the front and rear edges or side edges of top assembly 4, are substantially identical, except they are of different lengths. It is to be understood that the present invention also contemplates other shapes and sizes of removable edges 13. Removable edges 13 can be used to vary the size, shape and function of the associated worksurface unit to mate with the intended work process, such as conferencing, computer support, writing surface, etc.

Figure 7:
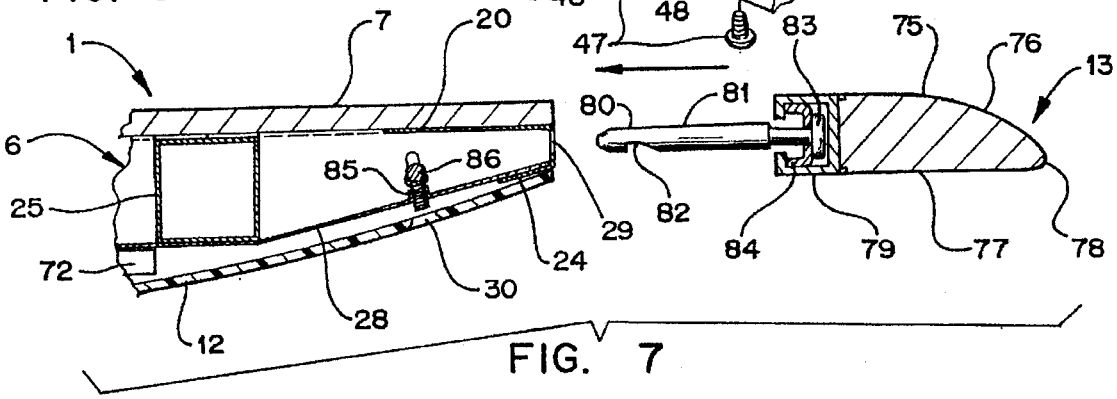
FIG. 7 is a fragmentary, vertical cross-sectional view of the worksurface frame, with a removable edge portion thereof shown in an exploded condition prior to assembly.

Each of the removable edges 13 is detachably mounted on an associated front or rear edge of top frame 6 in the following manner. As best illustrated in FIG. 7, each of the illustrated top removable edges 13 includes a contoured front portion 75, having a normally upwardly facing surface 76 that curves downwardly, and normally downwardly facing surface 77 that is generally flat and planar and mates with surface 76 along a rounded edge 78. A C-shaped channel 79 is mounted to the inner surface of edge portion 75, and supports mounting pins 80 therein. Each removable edge 13 includes at least two mounting pins 80 positioned adjacent opposite ends thereof, which align with mating fastener apertures 29. Each mounting pin 80 has a generally cylindrical shank 81 with an inclined notch 82 adjacent the free end thereof. The opposite end of shank 81 includes a rounded head 83 received in a retention channel 84, which is in turn captured within the interior of C-shaped channel 79, in a manner which permits mounting pin 80 to rotate axially with respect to removable edge 13. A set screw 85 is threadedly mounted in the adjacent outer gusset 28 of top frame 6, and has its headed end accessible through the window 30 in gusset 28. The interior end of set screw 85 includes a cross-pin 86, which is shaped to be closely received within the notch 82 of mounting pin 80, as shown in FIGS. 8 & 9.

To mount one of the removable edges 13 on the front or rear edge of top frame 6, the mounting pins 80 on the selected removable edge 13 are first aligned with the fastener apertures 29 in top frames 6, as shown in FIG. 7, and then inserted securely thereinto, so that the notches 82 on mounting pins 80 are positioned in registry with the cross pins 86 on set screws 85. Set screws 85 are then tightened, so as to securely draw movable edge 13 against the side edge of top frame 6, retaining the same in place, as illustrated in FIGS. 8 & 9. To reconfigure worksurface unit 1, the removable edges 13 can be removed from top assembly 4 by simply reversing the installation steps set forth above.

Figure 11:
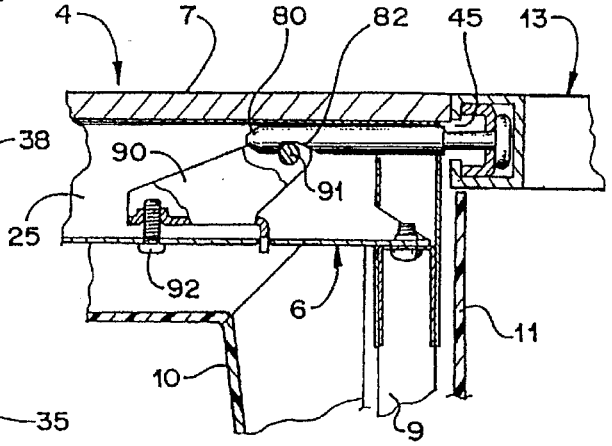
FIG. 11 is a fragmentary, vertical cross-sectional view of the worksurface frame, showing a removable edge connected to a side portion of the top.
Figure 12:
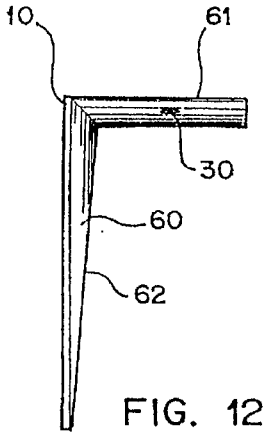
FIG. 12 is a front elevational view of an inner leg cover.

With reference to FIGS. 10 and 11, removable edges 13 are mounted to the sides of top frame 6 in a similar fashion. A lever 90 is mounted in the side portion of the top frame 6, and includes a pin 91 that is received within the notch 82 of mounting pin 80. A screw 92 is positioned in the opposite end of lever 90, and serves to rotate lever 90, so as to pull mounting pin 80 inwardly, and securely attach the removable edges 13 to the sides of top assembly 4.

Figure 8:
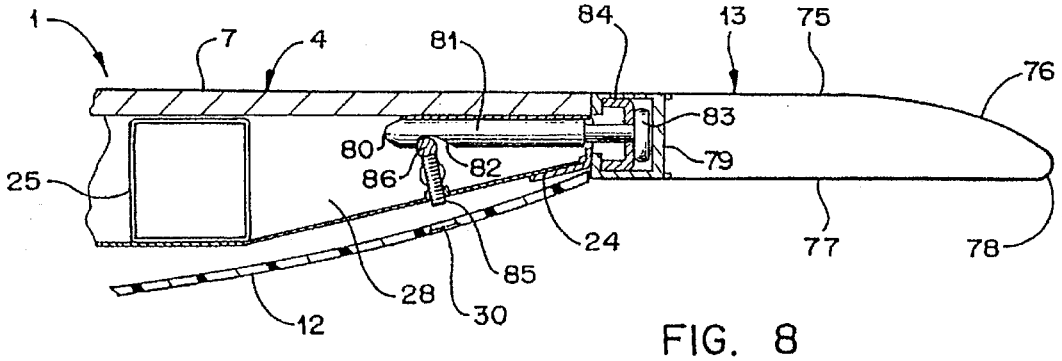
FIG. 8 is a fragmentary, vertical cross-sectional view of the worksurface frame, with the removable edge portion thereof shown in a fully assembled condition.
Figure 9:
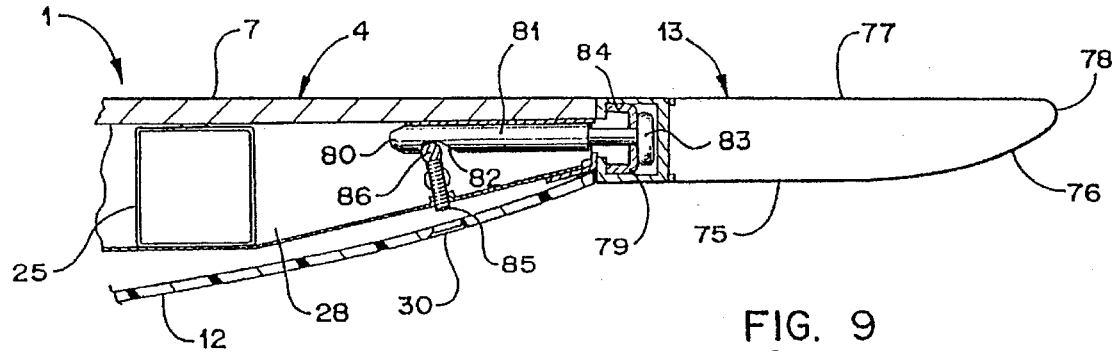
FIG. 9 is a fragmentary, vertical cross-sectional view of the worksurface frame, with the removable edge shown installed in a reversed, or upside down orientation.

As shown in FIGS. 7–9, the mounting pins 80 associated with each type of removable edge 13 are positioned symmetrically with respect to their associated front edge 75, and are axially rotatable with respect thereto, so that each of the removable edges 13 can be flipped or reversed into an upside down orientation to vary the top contour of worksurface unit 1, while using the same removable edges 13. For example, in the worksurface unit illustrated in FIG. 9, the normally upward surface 76 of edge 13 has been oriented downwardly, so that the outer edge portion of worksurface 1 is generally planar, instead of curved downwardly, as shown in FIG. 8.

A vertically adjustable removable edge 100 (FIG. 2) may also be provided to facilitate supporting keyboards, mouse pads, etc. at different heights along the front and rear edges of top assembly 4. The illustrated vertically adjustable removable edge 100 is substantially identical to the previously described straight cantilever extension edge **13*d*, except that the mounting pins 80 are replaced by a pair of hook-shaped brackets 101 that are positioned to be closely received in the slots 46 of leg frames 9. In this fashion, adjustable edge 100 can be located at any number of different vertical positions along the column of frame slots 46**.

With reference to FIG. 2, removable table edges 105 may also be provided for attachment to top assembly 4 to create a conferencing top configuration, or other unique top shapes. The illustrated table edge 105 has a penknife top 106 that is supported at least in part by a freestanding pedestal style leg 107. Top 106 has a straight side edge 108 which mates with the side edge of top assembly 4, and includes a pair of mounting pins 80 positioned to be received within fastener apertures 45. The side edge 108 of table edge 105 mounts to the associated side edge of top assembly 4 in the same manner as removable edges 13. It is to be understood that table edges 105 can be provided in a wide variety of different shapes and sizes to accommodate multiple workstation configurations.

The bifurcated construction of worksurface unit 1 with detachable top and leg frames 6 and 9 permits the same to be stored and shipped in a knock-down position to maximize economy. Typically, leg assemblies 9 (FIGS. 3–6A) will be removed from top assembly 5, with leg covers 10 and 11, and underbelly covers 12 disassembled. Removable plinth covers 52 and 53 may also be disassembled for transport. Worksurface unit 1 is assembled at the user site by simply attaching leg frames 9 to top frame 6 through the tab and slot interconnection discussed above. Leg covers 10 and 11, as well as underbelly covers 12 can be secured in place by suitable fasteners if they are not already attached. Removable edges 13 and 100, as well as table edges 105 are also attached to top assembly 4 in the manner described above, so as to complete the worksurface unit 1 and associated workstation.

The modular construction of worksurface unit 1 permits the same to be easily constructed in different widths using common parts. For example, the worksurface unit 1 illustrated in FIG. 3, has top assembly 4 in a width which requires a single underbelly cover 12. Worksurface unit 1 is also provided in additional lengths, in increments equal to the width of underbelly cover 12. In such longer worksurface units (FIG. 18), the top frame 6 is substantially identical, except that frame members 20–21 and 25–26 are longer, and additional cross gussets 27 & 28 are provided. Identical leg frames 9 and leg covers 10 and 11 are used with such wider worksurface units. Additional underbelly covers 12 are provided to cover the space between the horizontal leg portion 61 of inner leg covers 10, as shown in FIG. 18. Shorter worksurface units 1 can also be constructed by simply reducing the width of top assembly 4 in an amount equal to underbelly cover 12, such that the opposite side edges on the horizontal portions 61 of inner leg covers 10 abut one another.

Preferably, worksurface unit 1 is dimensioned so as to form a common core from which both U.S. and metric style worksurface units can be easily constructed. For example, extension edges **13*b* and 13*c* are dimensioned such that when attached to the front and rear edges of core worksurface unit 1, the overall depth of the worksurface unit is approximately divisible in whole U.S. measurement units, at a standard dimension, such as 24 inches, and is evenly divisible in whole metric measurement units, at a standard dimension, such as 10 centimeters, or the like. Different width extension edges 13 can also be provided to meet other standard dimensions in both U.S. and metric units. The dimensioning of the side removable edges can be similar. The vertical adjustability of leg frames 9 permits the height of worksurface unit 1** to be located in accordance with both U.S. and metric standards. Hence, the basic worksurface core unit has truly global adaptability.

As will be readily understood by those skilled in the art, worksurface units 1 can also be provided in a wide variety of different shapes and configurations, while incorporating the unique construction disclosed herein. In the example illustrated in FIG. 1, a narrow worksurface unit la is shown positioned back-to-back with a wider worksurface unit 1. Since worksurface 1 a is otherwise identical to previously described worksurface 1, similar parts appearing in the figures are represented by the same, corresponding reference numeral, except for the suffix "a" in the numerals of the former. A pedestal style leg 95 may also be provided for positioning at interior locations of an elongate worksurface, and a bridge worksurface 96 may be provided at selected corner locations. Vertically stacking storage units 97 may be supported on worksurface units 1 and/or **1*a***, and provide shelves, racks, and other similar storage facilities. Consequently, a fully integrated worksurface or desking system is provided which is very versatile, and is economical to manufacture in different shapes and sizes.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A worksurface unit, comprising:

a top having at least one side edge;

a support connected with said top and having a lower end thereof shaped for abutting support on a floor surface;

a removable edge shaped to mate with the side edge of said top, and including a normally upwardly facing surface having a first shape, and a normally downwardly facing surface having a second shape that is different from said first shape;

a fastener detachably connecting said edge to said top, and being symmetrically arranged to permit said edge to be connected to said top in an upside down orientation, with said second shape facing upwardly, to facilitate forming various top configuration; and wherein said top includes a marginal frame on which said edge is mounted;

said marginal frame includes horizontally oriented mounting apertures; and said fastener includes at least two pins shaded for close reception in said mounting apertures, and being mounted in said edge for axial rotation to facilitate mounting said edge in both orientations.

2. A worksurface unit as set forth in claim 1 wherein:

said top and said support include a tab and slot interconnection to permit knock-down storage and transport of said worksurface unit.

3. A worksurface unit as set forth in claim 2, including:

at least one underbelly cover positioned over a lower side of said top to cover at least a portion of the same.

4. A worksurface unit as set forth in claim 3, wherein:

said support includes a structural leg frame, an outer leg cover connected with an exterior side of said leg frame, and an inner leg cover connected with an interior side of said leg frame.

5. A worksurface unit as set forth in claim 4, including:

a plurality of said removable edges having different shapes and sizes to facilitate constructing various top configurations.

6. A worksurface unit as set forth in claim 1, including:

at least one underbelly cover positioned over a lower side of said top to cover at least a portion of the same.

7. A worksurface unit as set forth in claim 1, wherein:

said support includes a structural leg frame, an outer leg cover connected with an exterior side of said leg frame, and an inner leg cover connected with an interior side of said leg frame.

8. A worksurface unit as set forth in claim 1, including:

a plurality of said removable edges having different shapes and sizes to facilitate constructing various top configurations.

* * * * *

UNITED STATES PATENT AND TRADEMARK OFFICE

CERTIFICATE OF CORRECTION

PATENT NO. : 5,628,257
DATED : May 13, 997
INVENTOR(S) : John P. Conner et al.

It is certified that error appears in the above-indentified patent and that said Letters Patent is hereby corrected as shown below:

Column 3, line 6;

After "of the" insert –frame–.

Column 3, line 8;

After "worksurface" insert –frame–.

Column 5, line 62;

"potion" should be –portion–.

Column 9, claim 1, line 29;

"shaded" should be –shaped–.

Signed and Sealed this

Thirtieth Day of September, 1997

*Attest:*

*Attesting Officer*

Bruce Lehman

BRUCE LEHMAN

*Commissioner of Patents and Trademarks*